US007570234B2

(12) United States Patent
Yaguma

(10) Patent No.: US 7,570,234 B2
(45) Date of Patent: Aug. 4, 2009

(54) ORGANIC EL DRIVE CIRCUIT AND ORGANIC EL DISPLAY DEVICE USING THE SAME ORGANIC EL DRIVE CIRCUIT

(75) Inventor: Hiroshi Yaguma, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 827 days.

(21) Appl. No.: 11/165,275

(22) Filed: Jun. 24, 2005

(65) Prior Publication Data

US 2006/0017670 A1 Jan. 26, 2006

(30) Foreign Application Priority Data

Jun. 28, 2004 (JP) ..... 2004-189582

(51) Int. Cl.
*G09G 3/30* (2006.01)

(52) U.S. Cl. ..... 345/77; 345/80

(58) Field of Classification Search ..... 345/76–81, 345/82, 83, 204, 208, 209, 210; 315/169.1–169.3
See application file for complete search history.

(56) References Cited

U.S. PATENT DOCUMENTS 6,747,417 B2 6/2004 Meade et al.
2002/0135314 A1* 9/2002 Kitahara et al. ..... 315/169.3
2003/0184236 A1* 10/2003 Maede et al. ..... 315/169.1
2004/0155840 A1* 8/2004 Abe et al. ..... 345/76
2005/0024300 A1* 2/2005 Abe et al. ..... 345/76
2005/0099368 A1* 5/2005 Abe et al. ..... 345/76
2005/0219162 A1* 10/2005 Tsuge ..... 345/76
2005/0259050 A1* 11/2005 Fujisawa et al. ..... 345/76
2005/0270256 A1* 12/2005 Yaguma et al. ..... 345/76

FOREIGN PATENT DOCUMENTS

JP 2003-288045 10/2003

* cited by examiner

*Primary Examiner*—Chanh Nguyen
*Assistant Examiner*—Robert M Stone
(74) *Attorney, Agent, or Firm*—Mattingly & Malur, P.C.

(57) ABSTRACT

A first input terminal and a second input terminal of an organic EL drive circuit IC are arranged on both sides of the organic EL drive circuit IC, which are contiguous to sides of a plurality of IC's having identical circuit constructions to the organic EL drive circuit IC and arranged contiguously to the organic EL drive circuit IC, and a first output terminal and a second output terminal of the organic EL drive circuit IC are provided similarly. When a plurality of IC's are arranged along a column line of an organic EL display panel, it is possible to send a reference current generated by one of the IC or a current corresponding to the reference current to other IC's arranged on left or right sides of the one IC and the other IC's can receive the current sent from the first or second output terminal of the one IC through first or second input terminals of the other IC's, which are provided on sides of the other IC's adjacent to the one IC, and use the currents as reference currents thereof by reference current selector circuits thereof.

16 Claims, 2 Drawing Sheets

MPU
9
REGISTER
7
CONTROL CIRCUIT
8
RESET SIGNAL
12e
12b
12
3
3a
TPm
TPc
A/D
TP2
TP1
TPa
+Vcc
+VDD
Iref
1a
1
1b
Ir
TN2
TN1
GND
2c
2b
2
2a
2d
FF
CL
12a
12d
12c
12f
SW
Pn
Pi
P1
4n
4i
4
4a
DAT
REGISTER
6
Iro
TNa

ORGANIC EL DRIVE CIRCUIT AND ORGANIC EL DISPLAY DEVICE USING THE SAME ORGANIC EL DRIVE CIRCUIT

BACKGROUND OF THE INVENTION

1. Field of the Invention

The present invention relates to an organic EL drive circuit and an organic EL display device using the same organic EL drive circuit and, in particular, to an organic EL drive circuit and an organic EL display device, which can reduce unevenness of luminance on a display screen of an organic EL panel of the organic EL display device used in a portable telephone set, etc., due to difference in characteristics between column driver IC's, can reduce manufacturing cost of the column driver IC's and, particularly, is suitable for high luminance color display.

2. Description of the Related Art

An organic EL display panel of an active or passive type organic EL display device for use in a portable telephone set including 396 (132×3) terminal pins (column pins) for column lines (anode side drive lines of organic EL elements or data lines) and 162 terminal pins for row lines has been proposed. These numbers of the terminal pins for column lines and row lines tends to be increasing.

With such increase of the number of terminal pins, a plurality of column driver IC's becomes necessary on, particularly, the column line side. For example, in a full color QVGA, the number of terminal pins for each of the three primary colors becomes 120, so that a total of 360 terminal pins are necessary, that is, three column driver IC's are presently necessary. Therefore, there is a problem that unevenness of luminance appears on a display screen of an organic EL display device, due to difference in characteristics between column driver IC's and, particularly, due to variation of drive currents of the column driver IC's.

For example, U.S. Pat. No. 6,747,417 (corresponding to JP2003-288045A) discloses a technique for solving the above problem, by restricting unevenness of drive currents between column driver IC's by utilizing the fact that values of integrated paired resistors are substantially equal.

Since, however, the constructions of the reference current generator circuits of the master column driver IC and the slave column driver IC of the U.S. Pat. No. 6,747,417 are different, these column driver IC's shall be manufactured separately, resulting in that the manufacturing cost of the driver IC's becomes high.

On the other hand, the size of organic EL display panel tends to be increased and a large size organic EL display panel requires three or more column driver IC's. Further, the increase of the number of terminal pins makes unevenness of drive currents of terminal pins considerable. Therefore, in order to improve unevenness of drive currents, highly precise drive currents are required. As to the drive current control utilizing the paired resistors, since unevenness of resistance values of the paired resistors influences the drive currents, the use of paired resistors can not respond to the present request of further reduction of luminance unevenness.

SUMMARY OF THE INVENTION

An object of the present invention is to provide an organic EL drive circuit, which is capable of reducing luminance unevenness on a display screen of an organic EL display panel due to difference in characteristics between column driver IC's for driving the organic EL display panel and of reducing the fabrication cost of column driver IC's.

Another object of the present invention is to provide an organic EL display device capable of reducing luminance unevenness on a display screen of an organic EL display panel due to difference in characteristics between column driver IC's for driving the organic EL display panel and of reducing the fabrication cost of column driver IC's.

According to the present invention, in order to achieve the above objects, an integrated organic EL drive circuit or an organic EL display device using the same organic EL drive circuit, which is constructed with driver IC's and generates drive currents, which are to be supplied to terminal pins of the organic EL display device, on the basis of a reference current is featured by comprising a first and second input terminals provided for inputting currents, which are in phase with a reference current supplied externally of the driver IC's and have current values each corresponding to that of the reference current, a first and second output terminals, a reference current selector circuit for selecting one of the current inputted through the first input terminal, the current inputted through the second input terminal and the reference current, a current inverter circuit for inverting the one current selected by the reference current selector circuit with respect to the reference current and a current mirror circuit having an input side transistor and a first and second output side transistors and responsive to an output current of the current inverter circuit supplied to the input side transistor to generate currents having values corresponding to the value of the reference current in the first and second output side transistors and supply the currents to the first and second output terminals, respectively.

The driver IC is rectangular in plan view and the first and second input terminals thereof are arranged on respective sides of the rectangular IC, which face to sides of similar driver IC's when the latter driver IC's are provided adjacent to the driver IC. Similarly, the first and second output terminals of the driver IC are provided on sides thereof, respectively, such that the output terminals face to sides of similar driver IC'S.

Since, in the present invention, the first and second input terminals of the driver IC are arranged on respective sides of the rectangular IC, which face to sides of similar driver IC's when the latter driver IC's are provided adjacent to the driver IC and the first and second output terminals of the driver IC are provided on sides of the similar IC's, it is possible, when a plurality of driver IC's are arranged adjacently along a column line side of an organic EL display panel, to send the reference current generated in one of the driver IC (master driver IC) or a current corresponding to the reference current to a right side IC (slave driver IC), a left side IC (slave driver IC) or the both side driver IC's through the first and second output terminals. Each of the slave driver IC's arranged adjacent to the master driver IC can receive the current from the first or second output terminal of the master driver IC through one of a first input terminal and/or a second input terminal provided on sides thereof facing to the sides of the master driver IC and utilize it as a reference current thereof by a reference current selector circuit thereof.

In such case, since the input terminals and the output terminals of each driver IC are provided in adjacent sides thereof, terminal connecting lines between the IC's are short and variation of currents outputted from these IC's becomes negligibly small.

Therefore, current values of reference currents of the adjacently arranged IC's can be made substantially equal to the value of the reference current generated by the master driver IC, so that it is possible to reduce luminance unevenness on a screen of the organic EL display device due to difference in characteristics between the column driver IC's, which drive the organic EL display panel. Further, the master driver IC and the slave driver IC may have identical constructions and a number of driver IC's can be arranged in close relation to each other. Therefore, the manufacturing cost of the column driver IC can be reduced.

Incidentally, the column driver in this specification may be a driver IC for driving data line of the organic EL panel of the active matrix type or a driver IC for driving column lines of the organic EL panel of the passive matrix type.

DETAILED DESCRIPTION OF THE PREFERRED EMBODIMENTS

Figure 2:
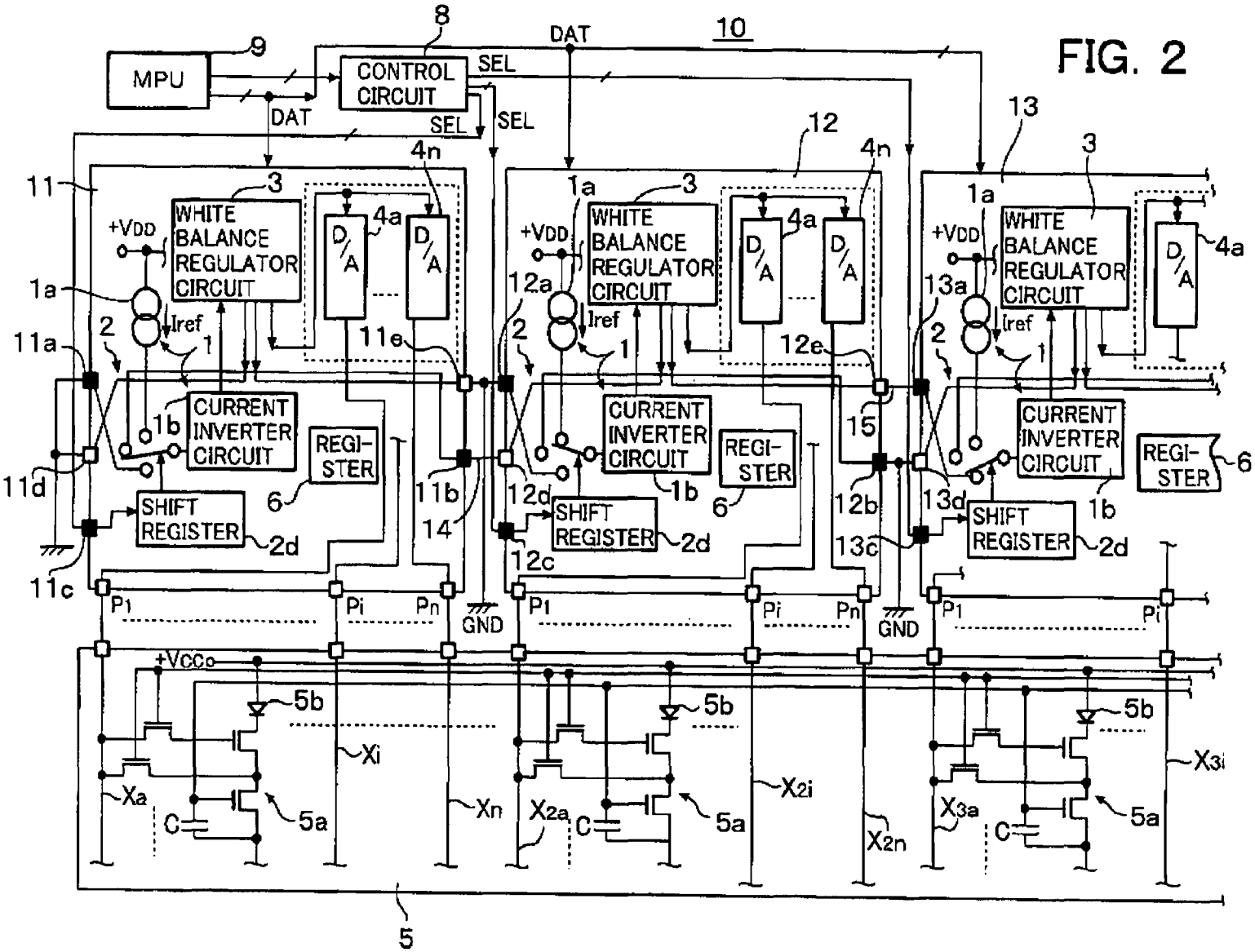
FIG. 2 is a block circuit diagram showing a whole construction of an organic EL display device.

In FIG. 2, a reference numeral 10 depicts an organic EL display device of active matrix type and reference numerals 11, 12 and 13 depict column driver IC's of an organic EL drive circuit of the organic EL display device.

The column driver IC's 11 to 13 have organic EL drive circuits having identical circuit constructions and are arranged closely to each other. In order to select one of a current supplied externally of an IC and a current generated in the IC and supply the selected current to an inner circuit thereof as a reference current, each of these column driver IC's includes a reference current generator circuit 1, a reference current selector circuit 2, a pair of output terminals for transmitting the reference current to one of adjacent IC's and a pair of input terminals for receiving the reference current from one of adjacent IC's.

Incidentally, in FIG. 2, the column driver IC 12 is a master driver IC and the driver IC's 11 and 13 arranged on both sides of the master driver IC are slave driver IC's.

Figure 1:
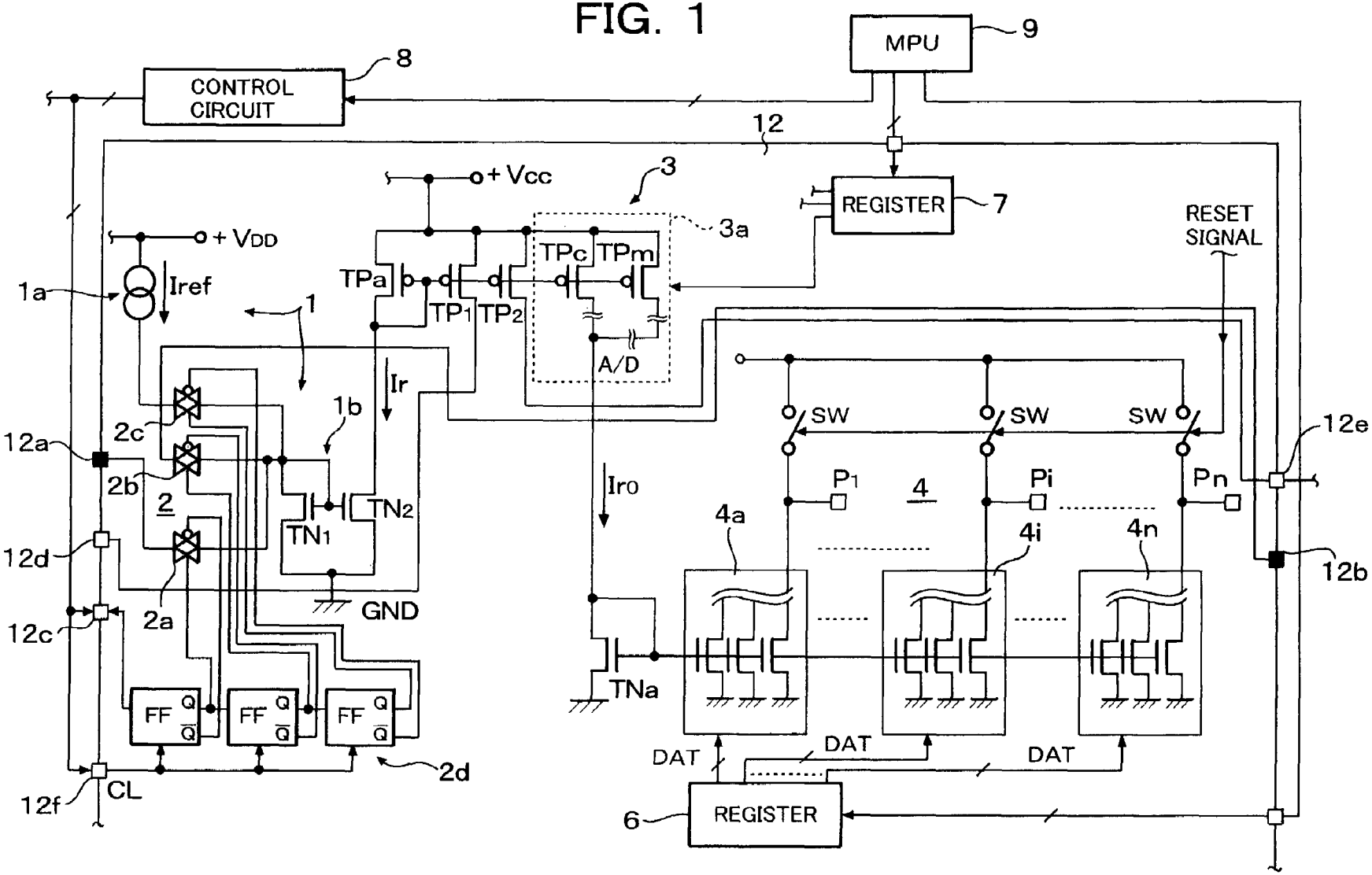
FIG. 1 is a block circuit diagram showing an inside construction of a column driver of an organic EL display device to which an organic EL drive circuit according to an embodiment of the present invention is applied.

As shown by the driver IC 12 as an example in FIG. 1, each of the driver IC's 11 to 13 includes the reference current generator circuit 1, the reference current selector circuit 2, a white balance regulator circuit 3 and a reference current distributor type D/A converter circuit 4, etc. The reference current distributor type D/A converter circuit 4 includes D/A conversion blocks 4*a* . . . 4*i* . . . 4*n* provided correspondingly to respective terminal pins of the organic EL panel.

The reference current distributor type D/A converter circuit 4 is constructed with a current mirror circuit including an input side transistor TNA and the D/A conversion blocks 4*a* . . . 4*i* . . . 4*n* each including a plurality of output side transistors and a corresponding number of switch circuits (not shown) connected in series with the respective output side transistors. The current mirror circuit constitutes a current switching D/A converter circuit. Thus, a reference drive current for driving the input side transistor TNA is distributed to the respective D/A conversion blocks 4*a* . . . 4*i* . . . 4*n*. The D/A conversion blocks 4*a* . . . 4*i* . . . 4*n* corresponding to respective terminal pins of the organic EL display panel generate analog currents corresponding to values of a display data DAT by converting the display data DAT supplied thereto by ON/OFF controlling the switch circuits according to the display data DAT.

Incidentally, output terminals P1 . . . Pi . . . Pn in FIG. 1 are output terminals of the driver IC 12 provided correspondingly to the terminal pins of the organic EL display panel 5, respectively, and reset switches SW are provided correspondingly to the respective output terminals P1 . . . Pi . . . Pn.

The white balance regulator circuit 3 is provided for each of R, G and B colors and data corresponding to each of R, G and B colors, which is stored in a register 7, is set in a D/A conversion block 3*a* of the white balance regulator circuit 3. The white balance regulator circuits 3 generate white balance regulated reference drive currents by converting the data of the respective R, G and B colors. The circuit construction from the reference current generator circuit 1 to the reference current distributor type D/A converter circuit is provided for each of R, G and B colors. Since the circuit constructions for the R, G and B colors are identical, an operation thereof is similar.

Incidentally, the data for R, G and B colors supplied externally to an MPU 9 as input data is temporarily stored in a non-volatile memory of the MPU 9 and set in the register 7 by transferring it to the register 7.

Returning to FIG. 2, input terminals 12*a* to 12*c* (shown by black square mark in FIG. 2) of the driver IC 12. The input terminals 12*a* and 12*c* are provided on the side of the driver IC 12 adjacent to the driver IC 11 and the input terminal 12*b* is provided on the side of the driver IC 12 adjacent to the driver IC 13. Output terminals 12*d* and 12*e* are output terminals (white square mark in FIG. 2) of the driver IC 12. The output terminal 12*d* is provided on the side of the driver IC 11 and the output terminal 12*e* is provided on the side of the driver IC 12 adjacent to the driver IC 13. Positions of one of the opposite sides of the driver IC 12, at which the input terminal and the output terminal are provided, are reversed with respect to positions of the other side of the driver IC 12.

That is, the input terminal 12*b* of the driver IC 12 corresponds in position to the output terminal 13*d* of the driver IC 13 and the output terminal 12*e* of the driver IC 12 corresponds in position to the input terminal 13*a* of the driver IC 13. The input terminal 12*a* of the driver IC 12 corresponds in position to the output terminal 11*e* of the driver IC 11 and the output terminal 12*d* of the driver IC 12 corresponds in position to the input terminal 11*b* of the driver IC 11. Therefore, the output terminals (white square marks) and the input terminals (black square marks) of the adjacent driver IC's are arranged in the corresponding positional relations.

The input terminals 11*a* to 11*c* of the driver IC 11 and the input terminal 13*a*, 13*b* (not shown) and 13*c* of the driver IC 13 correspond in position to the input terminals 12*a* to 12*c* of the driver IC 12 and the output terminals 11*d* and 11*e* of the driver IC 11 and the output terminals 13*d* and 13*e* (not shown) of the driver IC 13 correspond in position to the input terminals 12*a* to 12*c* and the output terminals 12*d* and 12*e* of the driver IC 12, respectively. The input terminals 11*a*, 11*b*, 12*a*, 12*b* and 13*a*, 13*b* and the output terminals 11*d*, 11*e*, 12*d*, 12*e* and 13*d*, 13*e* are used to receive/transmit a current Ir corresponding to the reference current between the driver IC's. Among rectangular driver IC's having input terminals and output terminals connected to respective terminal pins arranged in sides thereof, the rectangular driver IC's, which, when arranged adjacently, the terminal pins thereof substantially correspond in position to those of the adjacent driver IC's, are selected as the driver IC's 11, 12 and 13.

Therefore, the output terminal 12*d* of the driver IC 12 is adjacent to the input terminal 11*b* of the driver IC 11 and connected thereto by a short wiring line 14. The output terminal 12*e* of the driver IC 12 is adjacent to the input terminal 13*a* of the driver IC 13 and connected thereto by a short wiring line 15.

Incidentally, the input terminals 11*c*, 12*c* and 13*c* receive signals SEL for setting the driver IC's 11, 12 and 13 to a master IC or a slave IC. Since there is no corresponding relation between the adjacent driver IC's, terminal pins provided in arbitrary sides of the driver IC's may be assigned. Further, the rectangular driver IC is arranged such that a major side thereof extends along the terminal pins arranged in the column direction of the organic EL display panel 5, unlike the usual IC. It should be noted in FIG. 2, that an input terminal 12*f* (see FIG. 1) for a clock CLK, which is necessary to set the setting signals SEL, is not shown in FIG. 2.

As shown in FIG. 2, the D/A conversion blocks 4*a* to 4*n* of the reference current distributor type D/A converter circuit 4 are responsive to the display data DAT from the MPU 7 through the registers 6 to generate drive currents (usually, sink currents) corresponding to display luminance every moment by amplifying the reference drive current, which is supplied from the D/A conversion block 3*a* of the white balance regulator circuit 3, correspondingly to the display data. The thus generated drive currents are sent to pixel circuits 5*a* of the active matrix type organic EL panel 5 through output terminals P1 . . . Pi . . . Pn on the side of column line (data line) to charge capacitors C of the pixel circuits 5*a* and drives organic EL elements 5*b* of the pixel circuits 5*a*.

Further, as shown in FIG. 2, reference numerals Xa . . . Xi . . . Xn, X2*a* . . . X2*i* . . . X2*n* and X3*a* . . . X3*i* . . . X3*n* of the organic EL display panel 5 depict data lines (column lines) corresponding to the output terminals P1 . . . Pi . . . Pn of the driver IC's 11, 12 and 13, respectively.

As shown in FIG. 1 and FIG. 2, each of the reference current generator circuits 1 includes a reference current source 1*a* and a current inverter circuit 1*b* and a reference current selector circuit 2 is provided between the reference current source 1*a* and the current inverter circuit 1*b*.

The reference current selector circuit 2 is responsive to the setting signals SEL from a control circuit 8 to select one of an internally generated reference current Iref, a current Ir from a preceding IC and a current Ir from a succeeding IC as the reference current.

This circuit is constructed with analog switches (transmission gates) 2*a* to 2*c* and a shift register 2*d*. The shift register 2*d* is constructed with three flip-flop (FF) circuits connected in series. Incidentally, the setting signal SEL is set in the shift register 2*d* as 3-bit data, correspondingly to the shift clock CL, as to be described later.

The analog switches 2*a* and 2*b* are provided correspondingly to the respective input terminals 12*a* and 12*b* and one ends of the analog switches are connected to the respective input terminals 12*a* and 12*b*. One end of the analog switch 2*c* is connected to the reference current source 1*a* and receives the reference current Iref from the reference current source 1*a*. The other ends of the analog switches 2*a* to 2*c* are connected commonly to an input terminal of the current inverter circuit 1*b*.

An input terminal of an initial stage flip-flop of the shift register 2*d* is connected to the input terminal 12*c* and Q outputs of the flip-flops are supplied to non inversion side input terminals and Q-outputs (inverted Q outputs) thereof are supplied to the inversion input terminals as ON/OFF control signals for the analog switches 2*a* to 2*c*. Among the analog switches 2*a* to 2*c*, an analog switch corresponding to a flip-flop set to data "1" is driven. The initial stage flip-flop of the shift register 2*d* corresponds to the analog switch 2*a*, the next stage flip-flop corresponds to the analog switch 2*b* and the last stage flip-flop corresponds to the analog switch 2*c*. The analog switch corresponding to the flip-flop, which is set to "1", is turned ON and the analog switch driven by the flip-flop set to "0" is turned OFF.

The shift register 2*d* is responsive to a shift clock CL from a clock input terminal 2*f* (not shown in FIG. 2) to store the 3-bit data in the flip-flops by sequentially shifting the data "1" inputted to the initial stage flip-flop. Thus, the setting signals SEL are set in the respective driver IC's to thereby the selection of the state of the driver IC's, master or slave. Incidentally, the shift register 2*d* is reset to "0" in an initial state.

When the analog switch 2*a* is ON and the other analog switches are OFF, the setting signal SEL="001" is set in the shift register 2*d*. When the analog switch 2*b* is ON and the other analog switches are OFF, the setting signal SEL="010" is set in the shift register 2*d*. When the analog switch 2*c* is ON and the other analog switches are OFF, the setting signal SEL="100" is set in the shift register 2*d*. The 3-bit data is sent from the control circuit 8 to the input terminal 12*c* together with the shift clock CL.

Incidentally, the 3-bit data for selecting the reference current is simultaneously inputted from the control circuit 8 to the input terminals 11*c* and 13*c* of the respective driver IC's 11 and 12.

When the initial stage flip-flop is set to "1" and the analog switch 2*a* is turned ON, the reference current selector circuit 2 of the driver IC 12 selects the current Ir supplied from the preceding stage driver IC 11 to the input terminal 12*a* through the analog switch 2*a*. In such case, the driver IC becomes a slave driver IC. When the next stage flip-flop is set to "1" and the analog switch 2*b* is turned ON, the reference current selector circuit 2 of the driver IC 12 selects the current Ir supplied from the succeeding stage driver IC 13 to the input terminal 12*b* through the analog switch 2*b*. In such case, the driver IC 12 becomes a slave driver IC. When the last stage flip-flop is set to "1" and the analog switch 2*c* is turned ON, the reference current selector circuit 2 of the driver IC 12 selects the reference current Iref from the reference current source 1*a* through the analog switch 2*c*. Thus, the driver IC 12 becomes a master driver IC. Incidentally, the reference current source 1*a* is driven by a power source line +Vcc.

The current selected by the reference current selector circuit 2 is supplied to the current inverter circuit 1*b*. The current inverter circuit 1*b* is constructed with a current mirror circuit including an input side N channel MOS transistor TN1 and an output side N channel MOS transistor TN2. The diode-connected transistor TN1 has a drain connected to output terminals of the analog switches 2*a* to 2*c* and a source grounded.

The N channel MOS transistor TN2 has a drain connected to a drain of an input side transistor TPa and a source grounded.

Therefore, either the reference current Iref of the reference current source 1*a* or the current Ir, which is in phase to the reference current Iref and discharged from one of the input terminals 12*a* and 12*b*, is inputted to the current inverter circuit 1*b*. The current inverter circuit 1*b* generates a sink current (inverted current) as a mirror circuit and supplies the mirror current to the drain of the input side transistor TPa of the white balance regulator circuit 3.

The white balance regulator circuit 3 duplicates the mirror current and supplies the duplicated mirror currents to the output terminals 12*d* and 12*e* and the reference current distributor type D/A converter circuit 4. The white balance regulator circuit 3 is a current switching D/A converter constructed with a current mirror circuit composed of the D/A converter block 3*a* including a diode-connected, input side P channel MOS transistor TPa, two output side P channel MOS transistors TP1 and TP2 and a plurality of output side transistors. The switch circuits (not shown) are connected in series to the output side transistors of the D/A converter block 3*a*, respectively. The transistors TP1 and TP2 supply the currents Ir each corresponding to the reference current to the driver IC's 11 and 13, which are the slave driver IC's.

Sources of the output side transistors TP1 and TP2 and sources of the output side transistors TPc to TPm of the D/A conversion block 3*a* are connected to the power source line +Vcc, voltage of which is higher than the voltage of the power source line +VDD. Drains of the transistors TP1 and TP2 are connected to the output terminals 12*d* and 12*e*, respectively.

The D/A conversion block 3*a* is responsive to the data stored in the register 7 to generate a reference drive signal Iro, white balance of which is regulated, by converting the data. The reference drive current is supplied to the reference current distributor type D/A converter circuit 4.

Channel width (gate width) ratio of the input side transistors TPa to each of the transistors TP1 and TP2 is 1:1. The reference currents Ir, each of which is substantially equal to the reference current Iref and is in phase with the reference current Iref, are outputted from drains of the transistors TP1 and TP2 to the output terminals 12*d* and 12*e* as discharge currents, respectively. The transistors TP1 and TP2 are arranged preceding to the D/A converter circuit 3*a* with respect to the input side transistor TPa. Therefore, it is possible to generate a current Ir substantially equal to the reference current Iref with high precision.

Each D/A conversion block 4 is constructed with a plurality of output side transistors weighted correspondingly to weights of an 8-bit display data and switch circuits (not shown) connected in series with the weighted output side transistors, as a current switching D/A converter circuit. The switch circuits connected in series with the output side transistors and corresponding to the weights are ON/OFF controlled according to the display data in the register 6 and generate an analog current value, which is a total output currents of the output side transistors thus selected. The total current is outputted to the respective output terminals P1 . . . Pi . . . Pn as the drive currents.

As to the generation of the reference current, which is the base for generating the drive current, the driver IC 12 becomes the master driver IC and the driver IC's 11 and 13 become the slave driver IC's by the setting of the 3-bit data of the setting signal SEL.

The output terminal 12*d* of the driver IC 12 is connected to the input terminal 11*b* of the slave driver IC 11 through a wiring line 14 (see FIG. 2) and the output terminal 12*e* of the driver IC 12 is connected to the input terminal 13*a* of the slave driver IC 13 through a wiring line 15 (see FIG. 2). The wiring lines 14 and 15 for connecting terminals of the adjacent driver IC's are very short.

Therefore, the drain current of the transistor TP1 of the master driver IC 12 through the output terminal 12*d* and the wiring line 14, which is very short, to the input terminal 11*b* of the slave driver IC 11.

The output terminals 12*a* and 12*b* are grounded. Incidentally, the output currents of the transistors TP1 and TP2 are in the order of μA, a total power consumption is not substantially increased even when these currents flow to the ground GND. The output terminals 11*a*, 11*d* and 11*e* of the slave driver IC 11 and the output terminals 13*b*, 13*d* and 13*e* of the slave driver IC 13 are also grounded.

Since the driver IC 12 is the mater driver IC, there is no current from the input terminal 12*a*. Therefore, the setting signal SEL="100" supplied from the control circuit 8 is stored in the shift register 2*d*. Thus, the reference current source 1*a* is selected and the reference current Iref is inputted to the current inverter circuit 1*b*.

On the other hand, the slave driver IC 11 receives the setting signal SEL="010" from the control circuit 8. The setting signal is stored in the shift register 2*d*. Therefore, the input terminal 11*b* is selected and the current inverter circuit 1*b* receives not the reference current Iref from the reference current source 1*a* of the slave driver IC 11 but the current Ir corresponding to the reference current Iref from the drain of the transistor TP1 of the master driver IC 12 through the input terminal 11*b* and the analog switch 2*b*.

The slave driver IC 13 is responsive to the setting signal SEL="001" from the control circuit 8 to store it in the shift register 2*d*. Therefore, the input terminal 13*a* is selected and the current inverter circuit 1*b* receives the current Ir corresponding to the reference current Iref from the drain of the transistor TP2 of the driver IC 12 through the input terminal 13*a* and the analog switch 2*c*.

Therefore, the driver IC's 11 and 13 supply the currents Ir, each of which corresponds to the reference current Iref from the reference current source 1*a* of the reference current generator circuit 1 and is in phase with the reference current Iref, to their inner circuits, respectively. The input side P channel MOS transistors TPa of the white balance regulator circuits 3 of the slave driver IC's 11 and 13 are driven by the current Ir through the current inverter circuits 1*b* of the slave driver IC's 11 and 13 as in the driver IC 12, respectively.

As a result, the white balance regulator circuits 3 of the slave driver IC's 11 and 13 generate the reference drive currents Iro in the D/A converter circuits 3*a* on the basis of the respective reference currents Ir and the reference current distributor type D/A converter circuits 4 are driven by the reference drive currents Iro, respectively. Therefore, the drive currents to be supplied to the terminal pins of the organic EL display panel 5 are generated by the driver IC's 11 and 13.

As described, since on the basis of the reference current Iref of the reference current generator circuit 1*a* of the driver IC 12, the drive currents each of which is substantially equal to the reference current Iref, are generated by the slave driver IC's 11 and 13 arranged on both sides of the driver IC 12 through the identical circuits and the short wiring lines 14 and 15, the variation of drive currents is reduced.

In the described embodiment, the current inverter circuit 1*b* takes in the form of the current mirror circuit. However, the current inverter circuit may be substituted by a general current inverting amplifier constructed with an operational amplifier, etc. In any case, it is not necessary to make the input current of the current inverter circuit 1*b* equal to the output current thereof. It is enough that, in each driver IC, currents each corresponding to the reference current Iref of the reference current source 1*a* of the master driver IC are obtained at the input and output terminals.

The circuit for outputting the reference current Ir to the output terminals 12*d* and 12*e* is not limited to the white balance regulator circuit. For example, any current mirror circuit having an input side transistor driven by the reference current Iref or the reference current Ir and output side transistors for generating the reference currents Ir can be used in lieu of the white balance regulator circuit.

The white balance regulator circuit 3 is provided for each of R, G and B colors. Instead of the three white balance regulator circuits 3, it is possible to provide a single white balance regulator circuit 3 for the three primary colors and a single current mirror circuit including three D/A converter circuits 3*a* for the three primary colors. In such case, it is possible to use the circuit construction from the reference current generator circuit 1 to the white balance regulator circuit 3 commonly for the R, G and B colors.

Further, the input terminals 12*a* and the output terminal 12*d* are provided on one side (left side in FIG. 2) of the driver IC 12 and the input terminal 12*b* and the output terminal 12*e* are provided on the other side (right side in FIG. 2) thereof. The input and output terminals provided on a side of each of the adjacent driver IC's, which faces to the one side of the driver IC 12, and the input and output terminals provided on a side of the other adjacent driver IC, which faces to the other side of the driver IC 12, are arranged in positions reversed with respect to those of the input and output terminals of the driver IC 12 so that the input terminal and the output terminals of the driver IC 12 face to the output terminal and the input terminal of each adjacent driver IC, respectively. However, the facing relation of positions of the terminals on the side of each adjacent driver IC with respect to the driver IC 12 may not be necessary although the length of the wiring line between the terminals of the driver IC's increases slightly or the wiring lines cross each other. Therefore, it is not necessary to arrange the terminals of the driver IC's in such the way that the terminals of one driver IC face the terminals of other driver IC's when the driver IC's are arranged adjacently.

In this embodiment, the reference current selector circuit 2 is responsive to the master/slave setting signal SEL from the control circuit 8 to select either the internal reference current Iref or the externally inputted current Ir. However, the reference current selector circuit 2 may select the reference current Iref or the current Ir by forming a contact wiring pattern in a layer, in which a ROM is formed, such that the reference current selector circuit 2 can be connected to a contact on the side to be selected at the same time when data is written in the ROM. In such case, the reference current selector circuit 2 can be made as a selector current, which is selected in the mask option processing of the fabrication steps when data is written in the ROM. Therefore, in such case, there is no need of inputting bit data for selection to the reference current selector circuit 2. Further, there is no need of a hardware circuit including special logic circuit, etc., in this wiring connection. Alternatively, the reference current selector circuit may be constructed such that it includes fuses in respective wiring lines and the fuses are selectively cut in the fabrication step of the drive circuit.

Incidentally, so long as that the reference current selector circuit 2 selects, as the reference current thereof, either the reference current Iref of the reference current source 1*a* thereof or the externally supplied current Ir according to the data setting, it is possible, when the driver IC's are assembled to the display device and a display is made on the display device, to operate the slave driver IC's by separating them from the master driver IC after the reference current Iref of each driver IC is selected while watching unevenness of luminance on the display screen.

As described, in the present embodiment, the three driver IC's are provided in the organic EL display device. However, it is possible to send the current Ir of the driver IC 11 to a slave driver IC, which is provided preceding to the driver IC 11, by connecting the output terminal 11*a* of the driver IC to an input terminal of the slave driver IC. Similarly, it is possible to send the current Ir of the driver IC 13 to a slave driver IC provided succeeding to the driver IC 13. In such case, the slave driver IC can operate as the slave driver IC as well as the master driver IC. An output terminal of the slave driver IC is not grounded.

Therefore, the present invention can be applied to an organic EL display device having four or more driver IC's. Only one of the driver IC's 11 and 13 can be used as the slave driver IC.

Further, the described embodiment is constructed with mainly MOS FET's. However, it can be constructed with mainly bipolar transistors. Further, the N channel transistors (or npn type transistors) may be replaced by P channel (or pnp) transistors and the P channel (or pnp) transistors may be replaced by N channel (npn) transistors.

What is claimed is:

1. An organic EL drive circuit IC for driving an organic EL panel by generating drive currents corresponding to terminal pins of said organic EL display panel on the basis of a reference current, comprising:

a first and second input terminals provided for inputting an externally supplied current corresponding to and in phase with the reference current;

a first and second output terminals;

a reference current selector circuit for selecting one of the current inputted to said first input terminal, a current inputted to said second input terminal and the reference current;

a current inverter circuit for inverting phase of the current selected by said reference current selector circuit with respect to the reference current; and a current mirror circuit having an input side transistor for receiving an output current of said current inverter circuit and a first and second output side transistors for generating currents each corresponding to the reference current and supplying the currents to said first and second output terminals, wherein said organic EL drive circuit IC is rectangular, said first and second input terminals are arranged on opposite sides of said rectangular IC, which are adjacent to sides of other rectangular IC's each having a circuit construction identical to a circuit construction of said organic EL drive circuit IC, when said organic EL drive circuit IC and said other rectangular IC's are arranged adjacent each other, and said first and second output terminals are arranged similarly to said first and second input terminals.

2. The integrated organic EL drive circuit IC as claimed in claim 1, further comprising a reference current generator circuit for generating the reference current, wherein said current mirror circuit further includes a third output side transistor, the drive current is generated correspondingly to an output current of said third output side transistor.

3. The integrated organic EL drive circuit IC as claimed in claim 2, wherein said first and second output side transistors of said current minor circuit are arranged preceding to said third output side transistor with respect to said input side transistor.

4. The integrated organic EL drive circuit IC as claimed in claim 3, wherein the output current of said first or second output side transistor is supplied to a first or second input side terminal of another IC having a circuit construction identical to said circuit construction of said organic EL drive circuit IC.

5. The integrated organic EL drive circuit IC as claimed in claim 3, wherein said first or second input terminal receives an output current of a first or second output side transistor of another IC having a circuit construction identical to said circuit construction of said organic EL drive circuit IC.

6. The integrated organic EL drive circuit IC as claimed in claim 2, wherein said first input terminal and said first output terminal are arranged on one of said opposite sides and said second input terminal and said second output terminal are arranged on the other side of said opposite sides, positions of said second input terminal and said second output terminal on said one side are reversed to positions of said first input terminal and said first output terminal on said the other side.

7. The integrated organic EL drive circuit IC as claimed in claim 6, wherein said organic EL drive circuit IC is a first IC as a master driver, said other IC having a circuit construction identical to said circuit construction of said first IC is a second IC as a slave driver, one of said first and second output terminals of said first IC is connected to the other of said first and second input terminals of said second IC, said reference current selector circuit of said first IC selects a reference current from said reference current generator circuit of said first IC and said reference current selector circuit of said second IC selects a current inputted to the other of said first and second input terminals thereof.

8. The integrated organic EL drive circuit IC as claimed in claim 7, further comprising a third IC having a circuit construction identical to said circuit construction of said second IC, wherein said second output terminal of said first IC is connected to said first input terminal of said third IC, said reference current selector circuit of said second IC selects a current inputted to said second input terminal of said second IC and said reference current selector circuit of said third IC selects a current inputted to said first input terminal of said third IC.

9. The integrated organic EL drive circuit IC as claimed in claim 8, wherein said current minor circuit includes a D/A conversion block having a plurality of said third output side transistors, said D/A conversion block generates a current regulated with respect to the current inputted to said input side transistor and the drive current is generated correspondingly to an output current of said D/A conversion block.

10. The integrated organic EL drive circuit IC as claimed in claim 9, wherein said current mirror circuit is constructed with P channel MOS transistors, the output current of said D/A conversion block is inputted to another current minor circuit, said another current minor circuit include other D/A conversion blocks provided correspondingly to said respective terminal pins, each said other D/A conversion block being constructed with a plurality of output side transistors.

11. The integrated organic EL drive circuit IC as claimed in claim 2, wherein said reference current selector circuit selects said one current by a selection of wiring lines during a manufacturing step or in response to a predeterniined selection signal supplied through a third input terminal externally of said IC.

12. The integrated organic EL drive circuit IC as claimed in claim 11, wherein said predetermined selection signal includes a predetermined number of bits, said reference current selector circuit is constructed with three analog switches, one end of one of said analog switches is connected to said reference current generator circuit, one of another of said analog switches is connected to said first input terminal, one end of the remaining analog switch is connected to said second input terminal, the other ends of said three analog switches are commonly connected to said current inverter circuit and one of said three analog switches is turned ON and the other two of said analog switches are turned OFF by said bit signal.

13. An organic EL display device including a plurality of IC's for driving an organic EL display panel by generating drive currents corresponding to terminal pins of said organic EL display panel on the basis of a reference current, each said IC comprising:

a first and second input terminals provided for inputting an externally supplied current corresponding to and in phase with the reference current; a first and second output terminals; a reference current selector circuit for selecting one of the current inputted to said first input terminal, a current inputted to said second input terminal and the reference current; a current inverter circuit for inverting phase of the current selected by said reference current selector circuit with respect to the reference current; and a current mirror circuit having an input side transistor for receiving an output current of said current inverter circuit and a first and second output side transistors for generating currents each corresponding to the reference current and supplying the currents to said first and second output terminals, wherein each said IC is rectangular, said first and second input terminals are arranged on opposite sides of said IC, which are adjacent to sides of other IC's when the plurality of said IC's are arranged adjacent each other, and said first and second output terminals are arranged similarly to said first and second input terminals.

14. The organic EL display device as claimed in claim 13, wherein each said IC includes a reference current generator circuit for generating the reference current, said current mirror circuit of each said IC includes a third output side transistor and the drive current is generated by said IC correspondingly to an output current of said third output side transistor.

15. The organic EL display device as claimed in claim 14, wherein the output current of said first or second output side transistor of one of the plurality of said IC's is inputted to said first or second input terminal of at least one of the remaining IC's through said first or second output terminal thereof.

16. The organic EL display device as claimed in claim 15, wherein said first and second output side transistors of the plurality of said IC's are arranged preceding to said third output side transistors with respect to said input side transistors, respectively.

* * * * *